US008052298B2

(12) United States Patent
Wung et al.

(10) Patent No.: US 8,052,298 B2
(45) Date of Patent: Nov. 8, 2011

(54) LED LAMP

(75) Inventors: Shih-Hsun Wung, Taipei Hsien (TW); Yong-Dong Chen, Shenzhen (CN); Wen Xu, Shenzhen (CN); Ye-Ke Xie, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 399 days.

(21) Appl. No.: 12/329,609

(22) Filed: Dec. 7, 2008

(65) Prior Publication Data

US 2009/0303712 A1 Dec. 10, 2009

(30) Foreign Application Priority Data

Jun. 6, 2008 (CN) ..... 2008 1 0067673

(51) Int. Cl.
*F21S 4/00* (2006.01)

(52) U.S. Cl. ..... 362/219; 362/419

(58) Field of Classification Search ..... 362/418, 362/427, 217.16–217.17, 217.12–217.13, 362/225, 219–220, 217.01; 24/546, 457–458; 248/680, 505–506, 500, 231.81, 316.7; 361/709, 361/693, 690, 688, 679.54, 679.02, 710; 165/80.2, 80.3
See application file for complete search history.

(56) References Cited

U.S. PATENT DOCUMENTS

| | | | | |
|---|---|---|---|---|
| 5,132,874 | A * | 7/1992 | Chandler et al. | 361/722 |
| 6,229,703 | B1 * | 5/2001 | Lee | 361/704 |
| 6,339,533 | B1 * | 1/2002 | Lee et al. | 361/704 |
| 6,362,962 | B1 * | 3/2002 | Lee et al. | 361/704 |
| 6,518,507 | B1 * | 2/2003 | Chen | 174/252 |
| 6,765,794 | B1 * | 7/2004 | Inoue | 361/695 |
| 6,768,641 | B2 * | 7/2004 | Li | 361/719 |
| 6,822,869 | B2 * | 11/2004 | Huang et al. | 361/704 |
| 6,882,534 | B2 * | 4/2005 | Wang et al. | 361/704 |
| 6,938,783 | B2 * | 9/2005 | Chung | 211/41.18 |
| 7,518,874 | B2 * | 4/2009 | Deng et al. | 361/710 |
| 7,768,784 | B2 * | 8/2010 | Lai et al. | 361/710 |
| 2003/0210528 | A1 | 11/2003 | Huang et al. | |
| 2004/0001315 | A1 * | 1/2004 | Li | 361/697 |
| 2004/0037038 | A1 * | 2/2004 | Kun et al. | 361/695 |
| 2004/0066626 | A1 * | 4/2004 | Lee et al. | 361/704 |
| 2005/0265019 | A1 * | 12/2005 | Sommers et al. | 362/217 |
| 2006/0133090 | A1 * | 6/2006 | Noh et al. | 362/294 |
| 2006/0279946 | A1 * | 12/2006 | Park et al. | 362/97 |

FOREIGN PATENT DOCUMENTS

CN 1794059 A 6/2006

* cited by examiner

*Primary Examiner* — Julie Shallenberger
(74) *Attorney, Agent, or Firm* — Altis Law Group, Inc.

(57) ABSTRACT

An LED lamp includes a housing, a heat sink received in the housing, a plurality of LED modules thermally attached to the heat sink and a plurality of wire clips spanning over the heat sink and securing the heat sink on the housing. The heat sink includes a base and a plurality of fins extending from the base. Each of the clips includes a pivoting portion pivotally mounted on the housing, two locking portions located opposite to the pivoting portion and detachably engaging with the housing, and two pressing portions respectively interconnecting the pivoting portion with the two locking portions and abutting against the base.

13 Claims, 4 Drawing Sheets

LED LAMP

BACKGROUND OF THE INVENTION

1. Field of the Invention

The present invention relates to an LED lamp, and particularly to an LED lamp having a heat sink and a plurality of clips for readily securing the heat sink mounted with LED modules to the LED lamp.

2. Description of Related Art

An LED lamp is a type of solid-state lighting device that utilizes light-emitting diodes (LEDs) as a source of illumination. The LED has an advantage that it is resistant to shock, and has an almost eternal lifetime under a specific condition; thus, the LED lamp is intended to be a cost-effective yet high quality replacement for incandescent and fluorescent lamps. Conventionally, the LED lamp has a heat sink. LED modules are intimately mounted on the heat sink so heat generated by the LED modules can be dissipated by the heat sink. For a removal or reinstallment of the heat sink, multiple screws need to be loosened or fastened which makes operation of the removal or the reinstallment complicated and tedious. The problem is more serious when the assembly and disassembly of the heat sink of the LED lamp are operated outdoors and at a high level, since the screws may drop from the LED lamp during the operation, which is occurred when the LED lamp is used as, for example, a highway lamp.

What is needed, therefore, is an improved LED lamp which can overcome the described disadvantages.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
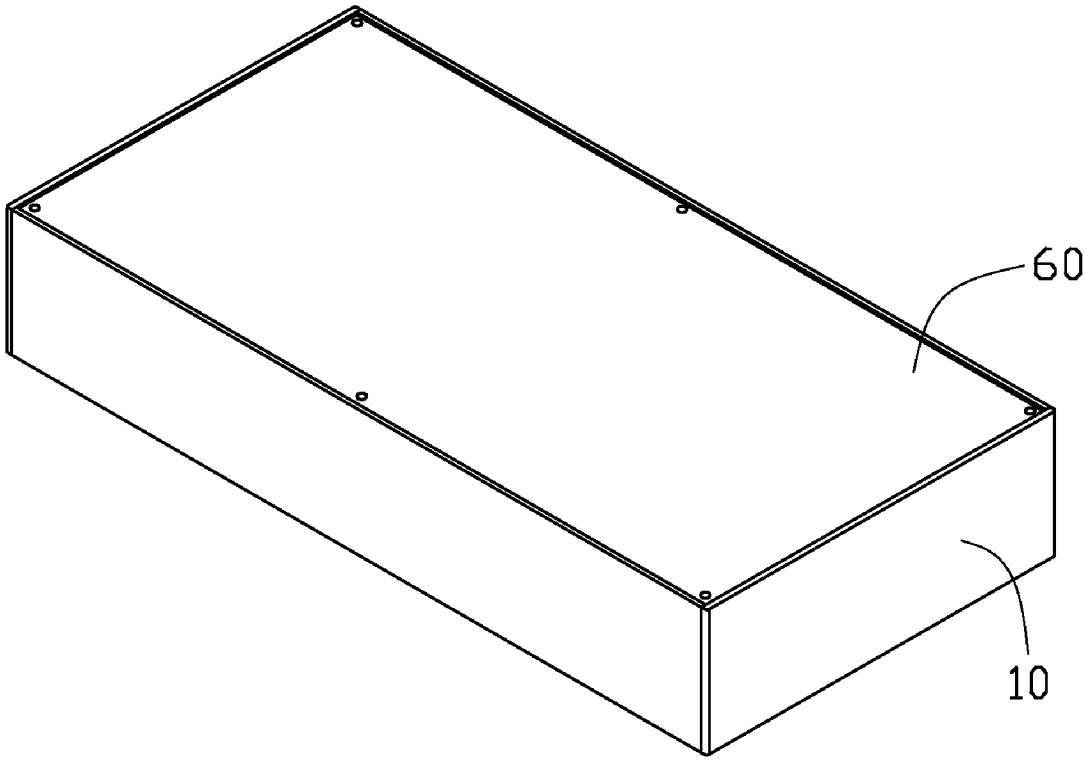
FIG. 1 is an isometric, assembled view of an LED lamp in accordance with a preferred embodiment of the disclosure.
Figure 2:
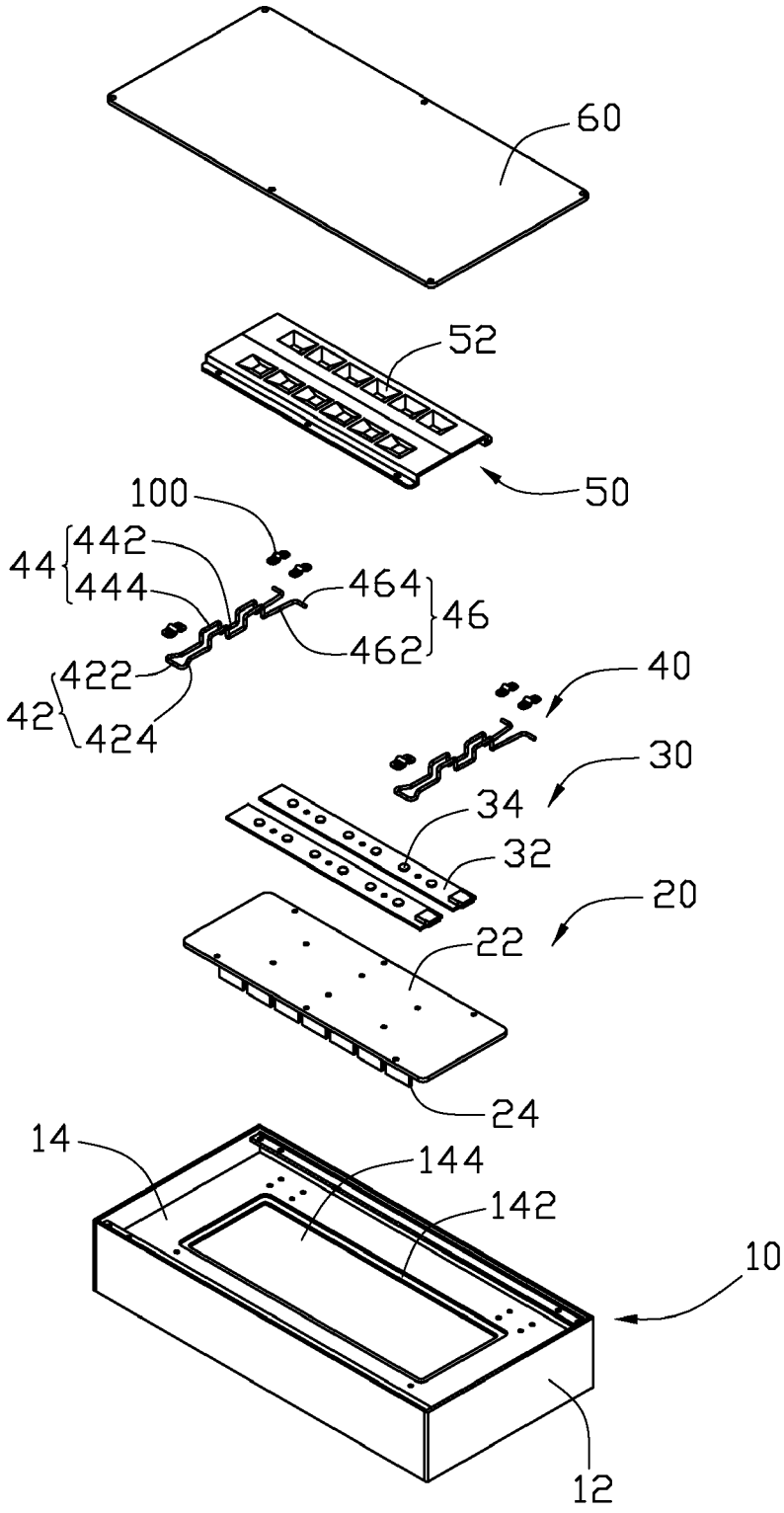
FIG. 2 is an exploded view of the LED lamp in FIG. 1.

Referring to FIGS. 1-2, an LED lamp in accordance with an embodiment is illustrated. The LED lamp comprises a housing 10, a heat sink 20 received in the housing 10, a plurality of wire clips 40 securing the heat sink 20 to the housing 10, a plurality of LED modules 30 mounted on the heat sink 20, a light-guiding board 50 disposed on the LED modules 30 and a lens 60 engaged with the housing 10 and covering the LED modules 30 and the light-guiding board 50.

Figure 3:
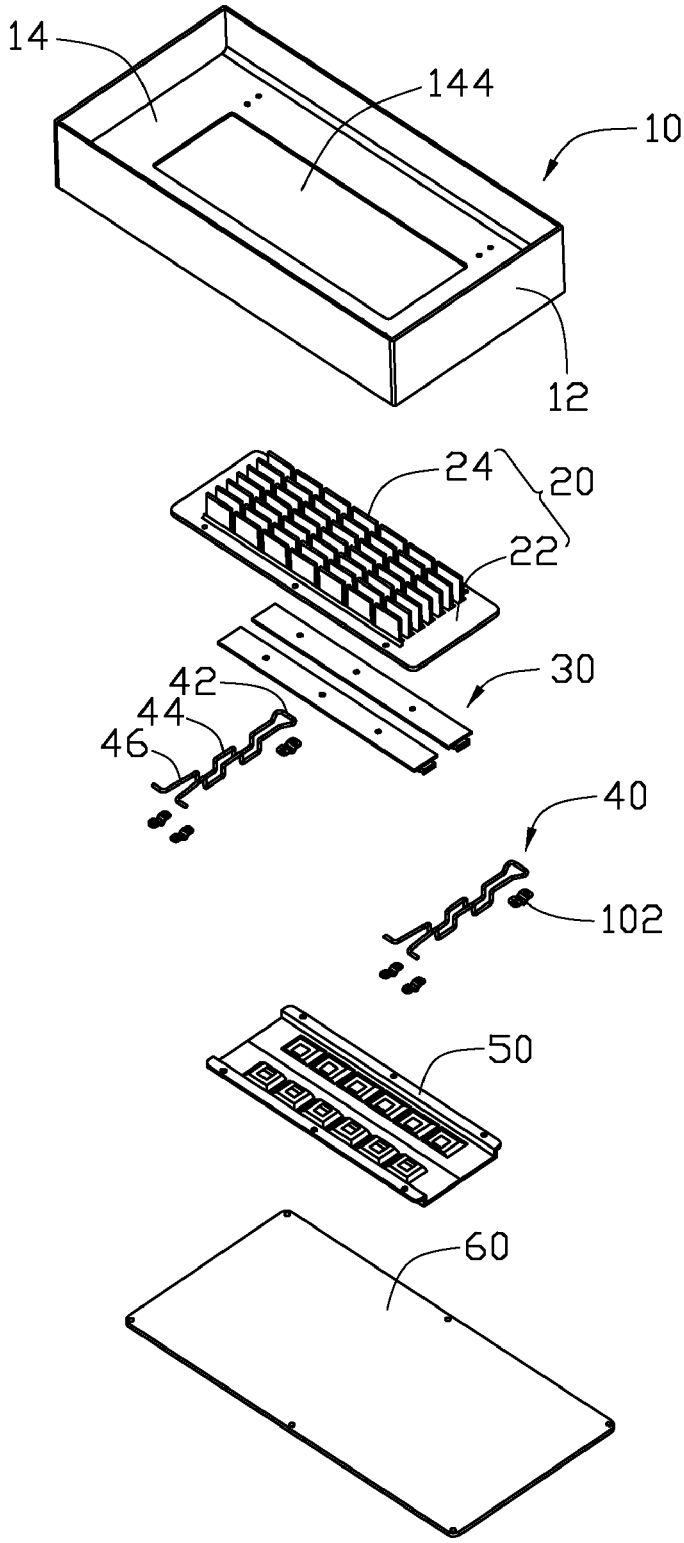
FIG. 3 is an inverted view of the LED lamp in FIG. 2.

Also referring to FIG. 3, the housing 10 is cuboid, comprising a frame 12 formed by four vertical sidewalls (not labeled) interconnected together and a supporting board 14 extending inwardly from inner sides of the sidewalls of the frame 12. The supporting board 14 is perpendicular to the sidewalls of the frame 12 and located near top ends of the side walls to thereby divide a space (not labeled) in the housing 10 into an upper small part (not labeled) and a lower large part (not labeled). The supporting board 14 defines a rectangular through hole 144 in a central portion thereof. The supporting board 14 forms an annular supporting portion 142 surrounding the through hole 144. The supporting portion 142 recesses downwardly from a top surface of the supporting board 14 for fitly supporting the heat sink 20 thereon. Two flanges 16 respectively extend inwardly from inner sides of two opposite longitudinal sidewalls and are located close to a top of the housing 10 for supporting the lens 60.

The heat sink 20 is made of a metal with high heat conductivity, comprising a rectangular base 22 and a plurality of fins 24 extending downwardly from a bottom surface of the base 22. The base 22 has a configuration similar to that of the supporting portion 142, whereby the base 22 could be fitly received in the supporting portion 142, wherein the fins 24 correspondingly extend through the through hole 144 of the supporting portion 142 into the lower large part of the space of the housing 10.

The LED modules 30 are mounted side by side on a top surface of the base 22 of the heat sink 20. Each of the LED modules 30 comprises an elongated printed circuit board 32 and a plurality of LEDs 34 mounted on the printed circuit board 32 and arranged along a longitudinal direction of the printed circuit board 32. The printed circuit boards 32 are secured on the top surface of the base 22 and parallel to longitudinal sides of the base 22.

Figure 4:
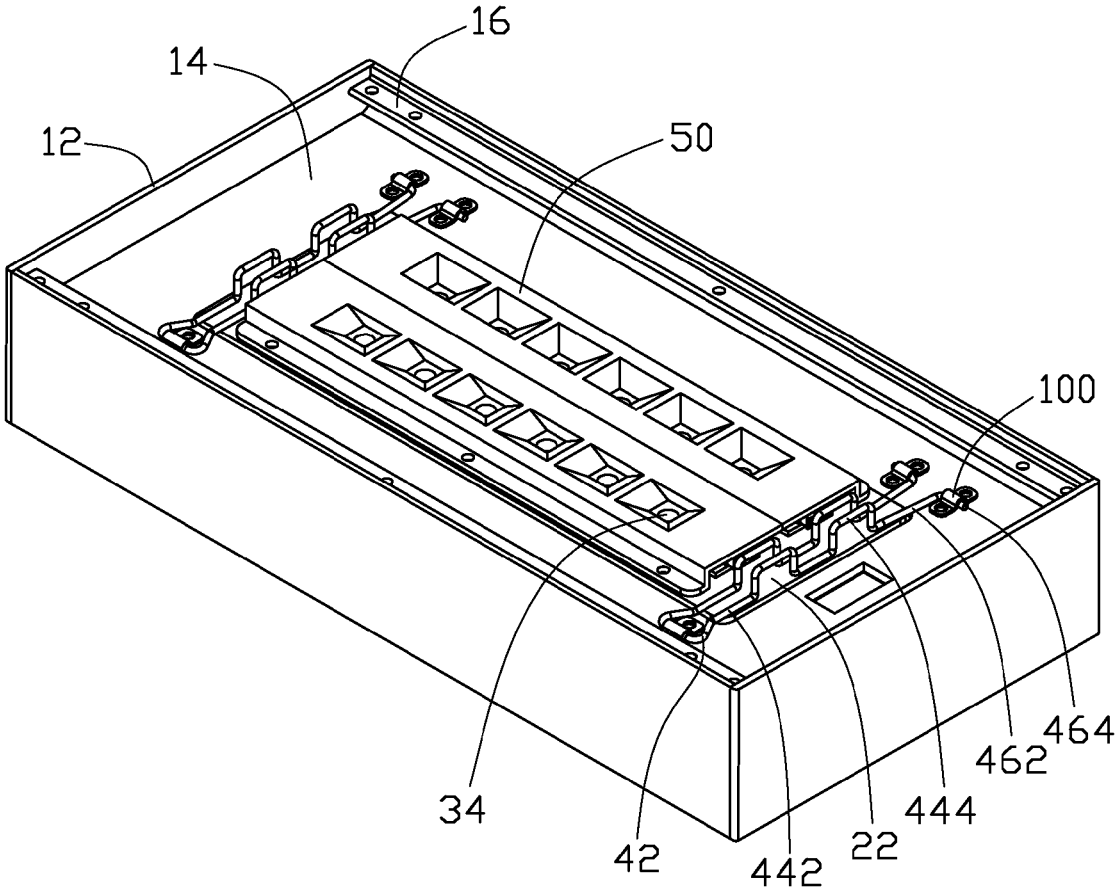
FIG. 4 is a view similar to FIG. 1, with a lens of the LED lamp being removed for clarity.

Also referring to FIG. 4, two wire clips 40 respectively span over two opposite sides of the base 22 of the heat sink 20 for securely fastening the heat sink 20 to the supporting portion 142 of the housing 10. Each of the clips 40 comprises a pivoting portion 42 pivotally mounted on the supporting board 14 of the housing 10, two locking portions 46 detachably fixed to the supporting board 14 and two pressing portions 44 respectively connecting two opposite ends of the pivoting portion 42 with the two locking portions 46. The clips 40 are further provided with a plurality of mounting members 100 mounted on the supporting board 14 of the housing 10 for fixing the clips 40 to the supporting board 14. The mounting member 100 is integrally formed by stamping or bending a metal sheet. A central portion 102 of the mounting member 100 expands upwardly for receiving a corresponding part of the clip 40 therein. The pivoting potion 42 comprises a straight section 422 and two curved arms 424 bending obliquely towards each other from two opposite ends of the straight section 422. The straight section 422 of the pivoting portion 42 is sandwiched between the supporting board 14 and a mounting member 100 positioned adjacent to one of the longitudinal sides of the supporting portion 142 of the supporting board 14. The two curved arms 424 respectively interconnect the straight section 422 with the two pressing portions 44. The pressing portions 44 span over the heat sink 20 and are rested on the top surface of the base 22 of the heat sink 20. Each of the pressing portions 44 comprises a plurality of horizontal, lower sections 442 aligned with and spaced from each other, and a plurality of inverted U-shaped, upper sections 444 protruding upwardly and respectively interconnecting two adjacent lower sections 442. The lower sections 442 are alternate with the upper sections 444. In addition, the lower sections 442 and the upper sections 444 are on the same vertical plane. When the clip 40 is disposed on the base 22 of the heat sink 20, the lower sections 442 of the pressing parts 44 press the top surface of the base 22 of the heat sink 20 downwardly toward the annular supporting portion 142 of the housing 10; the upper sections 444 are perpendicular to the top surface of the base 22. Each of the locking portions 46 comprises a connecting section 462 extending outwardly and slantwise from a distal end of each of the pressing portions 44 and a hooking section 464 bending outwardly from the connecting section 462. The two hooking sections 464 are respectively inserted into the central portions of two mounting members 100 positioned adjacent to the other longitudinal side of the supporting portion 142.

The light-guiding board 50 is placed over the LED modules 30 and fixed to the heat sink 20. The light-guiding board 50 has a substantially rectangular configuration and defines a plurality of tapered cavities 52 respectively receiving the LEDs 34 of the LED modules 30 therein. When the LEDs 34 are activated, a part of light emitted from the LEDs 34 is able to emit to outside directly, and the remaining part of the light is reflected by inner faces of the light-guiding board 50 defining the cavities 52 to thus obtain a satisfactory illumination.

The lens 60 is rectangular plate shaped and made of transparent material such as plastic, glass or other suitable material availing to transmit light. Two opposite lateral side portions of the lens 60 are respectively disposed on the two flanges 16 of the housing 10.

To release the heat sink 20 from the housing 10, the two hooking sections 464 are pressed to move toward each other and disengage from the central portions 102 of the mounting members 100. The clip 40 can be rotated away from the heat sink 10 relative to the straight section 422 of the pivoting portion 42. Thus, the heat sink 20 can be easily removed. Also, reinstallment of the heat sink 20 follows steps opposite to the above process of releasing the heat sink 20. In addition, the provision of the upper sections 44 of the pressing portions 44 can facilitate the operation of the clips 40.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a housing having a sidewall and a supporting board extending inwardly from an inner side of the sidewall;

a heat sink received in the housing and comprising a base rested on the supporting board of the housing;

a plurality of LED modules mounted on a top surface of the base; and a plurality of wire clips each having two opposite end portions fixed to the supporting board and respectively located at two opposite sides of the base of the heat sink, and two pressing portions interconnecting the two end portions of each wire clip and depressing the top surface of the base;

wherein one end portion of the clip comprises a pivoting portion which is pivotally fixed on the supporting board, another end portion of the clip comprises a plurality of locking portions detachably fixed on the supporting board; and wherein the two pressing portions respectively extend from two opposite ends of the pivoting portion of each wire clip, each of the two pressing portions comprises a plurality of lower sections aligned with and spaced from each other for abutting against the top surface of the base, and a plurality of upper sections protruding perpendicularly to the base and respectively interconnecting two adjacent lower sections.

2. The LED lamp as claimed in claim 1, wherein the heat sink comprises a plurality of fins arranged on a bottom surface of the base, and the supporting board defines a through hole therein through which the fins extend.

3. The LED lamp as claimed in claim 2, wherein the supporting board forms an annular supporting portion surrounding the through hole and supporting the base of the heat sink thereon.

4. The LED lamp as claimed in claim 3, wherein the supporting portion recesses downwardly from a top surface of the supporting board.

5. The LED lamp as claimed in claim 1, wherein the base has a configuration similar to that of the supporting portion.

6. The LED lamp as claimed in claim 1, wherein each of the locking portions comprises a connecting section extending outwardly from a distal end of each of the pressing portions and a hooking section bending outwardly from the connecting section for engaging with the housing.

7. The LED lamp as claimed in claim 1, wherein each of the clips is further provided with a plurality of mounting members mounted on the supporting board of the housing, a central portion of each of the mounting members expands upwardly for receiving a part of a corresponding clip therein.

8. The LED lamp as claimed in claim 7, wherein the pivoting portion is sandwiched between the supporting board and a corresponding mounting member, whereby the clip can pivot in respect to the pivoting portion.

9. The LED lamp as claimed in claim 7, wherein a free end of each locking portion is correspondingly inserted into the central portion of a corresponding mounting member.

10. An LED lamp comprising:

a housing comprising a frame and a supporting board received in the frame, wherein the supporting board defines a through hole in a central portion thereof and an annular supporting portion protruding downwardly from inner edges of the through hole;

a heat sink comprising a base and a plurality of fins extending from the base, wherein the base is received in the supporting portion, and the fins extend downwardly through the supporting portion;

a plurality of LED modules are thermally attached to a top surface of the base; and a plurality of clips fastening the base to the supporting portion, wherein each of the clips comprises a pivoting portion which pivotally mounted on the supporting board, two locking portions located opposite to the pivoting portion and detachably engaging with the supporting board, and two pressing portions respectively interconnecting the pivoting portion with the two locking portions and abutting against the top surface of the base;

wherein the two pressing portions respectively extend from two opposite ends of the pivoting portion, each of the two pressing portions comprises a plurality of lower sections aligned with and spaced from each other for abutting against the top surface of the base, and a plurality of upper sections protruding perpendicularly to the base and respectively interconnecting two adjacent lower sections.

11. The LED lamp as claimed in claim 10, wherein each of the clips is further provided with a plurality of mounting members mounted on the supporting board, and a central portion of each of the mounting members expands upwardly for receiving a part of a corresponding clip therein.

12. The LED lamp as claimed in claim 10, wherein the locking portions respectively bending outwardly from the pressing portions, a free end of each locking portion is inserted into the central portion of a corresponding mounting member.

13. The LED lamp as claimed in claim 10, wherein the plurality of clips has a number of two and the two clips respectively span over two opposite ends of the base.

* * * * *